US009523233B2

(12) United States Patent
Keller et al.

(10) Patent No.: US 9,523,233 B2
(45) Date of Patent: Dec. 20, 2016

(54) SWING DOOR

(71) Applicant: Hi-Fold Door Corporation, River Falls, WI (US)

(72) Inventors: Richard D Keller, Hastings, MN (US); Damian Keller, River Falls, WI (US); Daniel Keller, River Falls, WI (US); William Bakalich, Prescott, WI (US)

(73) Assignee: Hi-Fold Door Corporation, River Falls, WI (US)

( * ) Notice: Subject to any disclaimer, the term of this patent is extended or adjusted under 35 U.S.C. 154(b) by 0 days.

(21) Appl. No.: 14/101,911

(22) Filed: Dec. 10, 2013

(65) Prior Publication Data

US 2014/0096449 A1 Apr. 10, 2014

Related U.S. Application Data

(62) Division of application No. 12/206,897, filed on Sep. 9, 2008, now abandoned.

(51) Int. Cl.

| | |
|---|---|
| ***E06B 3/38*** | (2006.01) |
| ***E05D 15/40*** | (2006.01) |
| ***E05D 15/38*** | (2006.01) |
| *E06B 3/70* | (2006.01) |

(52) U.S. Cl.

CPC ..... *E06B 3/38* (2013.01); *E05D 15/38* (2013.01); *E05D 15/401* (2013.01); *E06B 2003/7044* (2013.01)

(58) Field of Classification Search

CPC ..... E06B 3/01; E06B 3/32; E06B 3/325; E06B 3/38; E06B 9/00; E06B 9/02; E06B 9/06;E06B 2003/7044; E05F 15/04; E04B 1/08; E05C 19/00; E05C 19/003; E05C 19/005; E05D 15/38; E05D 15/40; E05D 15/401

(Continued)

(56) References Cited

U.S. PATENT DOCUMENTS

| | | | |
|---|---|---|---|
| 2,043,472 | A | 6/1936 | Eager et al. |
| 2,597,786 | A | 5/1952 | Fontaine |
| 2,610,366 | A | 9/1952 | McKee et al. |

(Continued)

OTHER PUBLICATIONS http://doorsandwindows.bobvila.com/Article/940.html, first knowledge of appearance of article on internet is Mar. 5, 2006, 4 pages.

*Primary Examiner* — Brian Mattei
*Assistant Examiner* — Catherine A Kelly
(74) *Attorney, Agent, or Firm* — Daniel J. Polglaze; Westman, Champlin & Koehler, P.A.

(57) ABSTRACT

A swing type garage door has one or more of several features, including a door body rotationally connected to a door frame, the door body having one or more of: a trussing system having vertical and horizontal truss members, the horizontal members having openings through which the vertical members extend to distribute a load on the door body to the door frame in both a vertical and a horizontal direction; first and second sections hingedly connected with a hinge to allow ease in transport; a main door body section and a door load truss section hingedly connected at a bottom of the main door body to provide load trussing when the door is open; and at least one brace rotatably connected to the door body on an interior thereof and rotatable between a first bracing position and a second storage position to brace in high wind loading conditions.

2 Claims, 8 Drawing Sheets

(58) Field of Classification Search
USPC ..... 49/501, 197, 199; 52/64, 456, 790.1, 52/783.1, 664
See application file for complete search history.

(56) References Cited

U.S. PATENT DOCUMENTS

| | | | | | |
|---|---|---|---|---|---|
| 2,804,953 | A | | 9/1957 | Buehler | |
| 2,993,572 | A | * | 7/1961 | Rich | 160/229.1 |
| 3,126,944 | A | | 3/1964 | Kempinski | |
| 4,083,150 | A | | 4/1978 | Smith | |
| 4,177,854 | A | | 12/1979 | DeVore | |
| 4,243,091 | A | | 1/1981 | DeVore | |
| 4,261,409 | A | | 4/1981 | DeVore | |
| 4,378,043 | A | | 3/1983 | Sorenson | |
| 4,765,093 | A | | 8/1988 | Edwards, Jr. | |
| 4,793,398 | A | | 12/1988 | Hoff et al. | |
| 4,827,667 | A | | 5/1989 | Jarvis | |
| 4,987,941 | A | | 1/1991 | Wold | |
| 5,133,123 | A | | 7/1992 | Rigg | |
| 5,371,970 | A | | 12/1994 | Ganikon | |
| 5,383,509 | A | | 1/1995 | Gaffney et al. | |
| 5,445,207 | A | | 8/1995 | Romanelli et al. | |
| 5,588,270 | A | | 12/1996 | Keating | |
| 5,706,877 | A | | 1/1998 | Grisham et al. | |
| 5,732,758 | A | * | 3/1998 | Marko | 160/201 |
| 5,749,407 | A | | 5/1998 | Brenner et al. | |
| 5,950,374 | A | * | 9/1999 | Gromat | 52/93.2 |
| 5,996,296 | A | * | 12/1999 | Bisbee | 52/284 |
| 6,062,293 | A | | 5/2000 | Berger, Jr. | |
| 6,112,799 | A | | 9/2000 | Mullet et al. | |
| 6,199,617 | B1 | | 3/2001 | Schweiss | |
| 6,244,013 | B1 | | 6/2001 | Lee | |
| 6,434,985 | B1 | | 8/2002 | Walmsley | |
| 6,463,988 | B1 | | 10/2002 | Mullet et al. | |
| 6,471,264 | B1 | * | 10/2002 | Ryan | E05C 1/04 292/251.5 |
| 6,776,210 | B2 | * | 8/2004 | Wells | E06B 3/485 160/209 |
| 6,866,080 | B2 | | 3/2005 | Schweiss | |
| 6,883,273 | B2 | * | 4/2005 | Kerkvliet | 49/199 |
| 7,086,443 | B2 | * | 8/2006 | Williams | E06B 3/485 160/209 |
| 7,438,114 | B2 | | 10/2008 | Fowler | |
| 7,469,737 | B2 | * | 12/2008 | Mullet | E05F 15/686 160/188 |
| D584,831 | S | * | 1/2009 | Parker | D25/61 |
| 7,874,342 | B2 | * | 1/2011 | Mullet | E05D 15/165 160/201 |
| 7,891,401 | B2 | * | 2/2011 | Decola | 160/264 |
| 8,627,872 | B2 | * | 1/2014 | Wedekind | E06B 3/485 160/201 |
| 8,651,165 | B2 | * | 2/2014 | Huynh | E05B 17/0058 160/205 |
| 2007/0056694 | A1 | * | 3/2007 | Mullet | E05D 15/165 160/201 |
| 2007/0151677 | A1 | * | 7/2007 | East | E06B 5/12 160/209 |
| 2008/0086947 | A1 | | 4/2008 | Crown | |
| 2009/0025334 | A1 | * | 1/2009 | Aquilina | E06B 3/485 52/784.13 |
| 2010/0229467 | A1 | * | 9/2010 | Perkins | E06B 9/17046 49/9 |

* cited by examiner

SWING DOOR

RELATED APPLICATION

This Application is a Divisional of U.S. application Ser. No. 12/206,897, titled "SWING DOOR," filed Sep. 9, 2008, (pending) which is commonly assigned and incorporated herein by reference.

FIELD

The present disclosure relates generally to swing type garage doors and in particular the present disclosure relates to loading and use of swing type garage doors

BACKGROUND

Garage doors of the swing-type are comprised of a door that remains in a single panel configuration even when the door is being opened and is open. Such doors are often opened and closed using hydraulic cylinders. These swing-type doors are of either unitary construction, or are manufactured in sections that must be assembled when the door sections are delivered to an installation site, requiring additional time and effort to assemble the door.

Further, swing type doors may have a truss permanently attached to a bottom of the door that provides added stability against drooping of the door when it is open. These built-on trusses require additional materials, and are permanent, so they can be obstacles in front of a door, as well as potential tripping points. Further doors with permanent trusses either require shipping a more unwieldy portion of door, or additional assembly time and effort when the door sections arrive at the installation location.

Wind loading on doors in high wind conditions can be very high. Such wind loading can lead to bowing or even buckling of doors. Some bracing systems for doors employ additional cross bracing within the door body frame, but even additional bracing cannot prevent damage in higher winds.

For the reasons stated above, and for other reasons stated below which will become apparent to those skilled in the art upon reading and understanding the present specification, there is a need in the art for improvements in swing type door bracing, trussing, and load distribution.

SUMMARY

In one embodiment, a swing type garage door includes a door body rotationally connected to a door frame, the door body rotatable between a first closed position and a second open position. The door body includes a trussing system with vertical truss members and horizontal truss members, the horizontal members having openings through which the vertical members extend, the openings having sides on either side of the vertical truss member, to distribute a load on the door body to the door frame in both a vertical and a horizontal direction.

In another embodiment, a swing type garage door includes a door body rotationally connected to a door frame, the door body rotatable between a first closed position and a second open position. The door body includes a first section and a second section hingedly connected with a hinge, the door body foldable from a first operating configuration in which the first and the second sections are pinned so that they form a substantially rigid door body, and a second transport configuration for storage and transport in which the first and second sections are folded about the hinge to reduce the effective dimensions of the door body.

In still another embodiment, a swing type garage door includes a door body rotationally connected to a door frame, the door body rotatable between a first closed position and a second open position. The door body has a main door body section and a door load truss section, the door load truss section hingedly connected at a bottom of the main door body and rotatable between a first configuration in which the main door body section and the door load truss section are substantially coplanar and a second configuration in which the door load truss section is substantially perpendicular to the main door body section.

In another embodiment, a swing type garage door includes a door body rotationally connected to a door frame, the door body rotatable between a first closed position and a second open position. The door body has at least one brace rotatably connected to the door body on an interior thereof, the at least one brace rotatably movable between a first bracing position in which the brace is positioned substantially perpendicular to a plane of the door body and a second storage position in which the brace is substantially coplanar and parallel to the door body.

Other embodiments are described and claimed.

DETAILED DESCRIPTION

Figure 1:
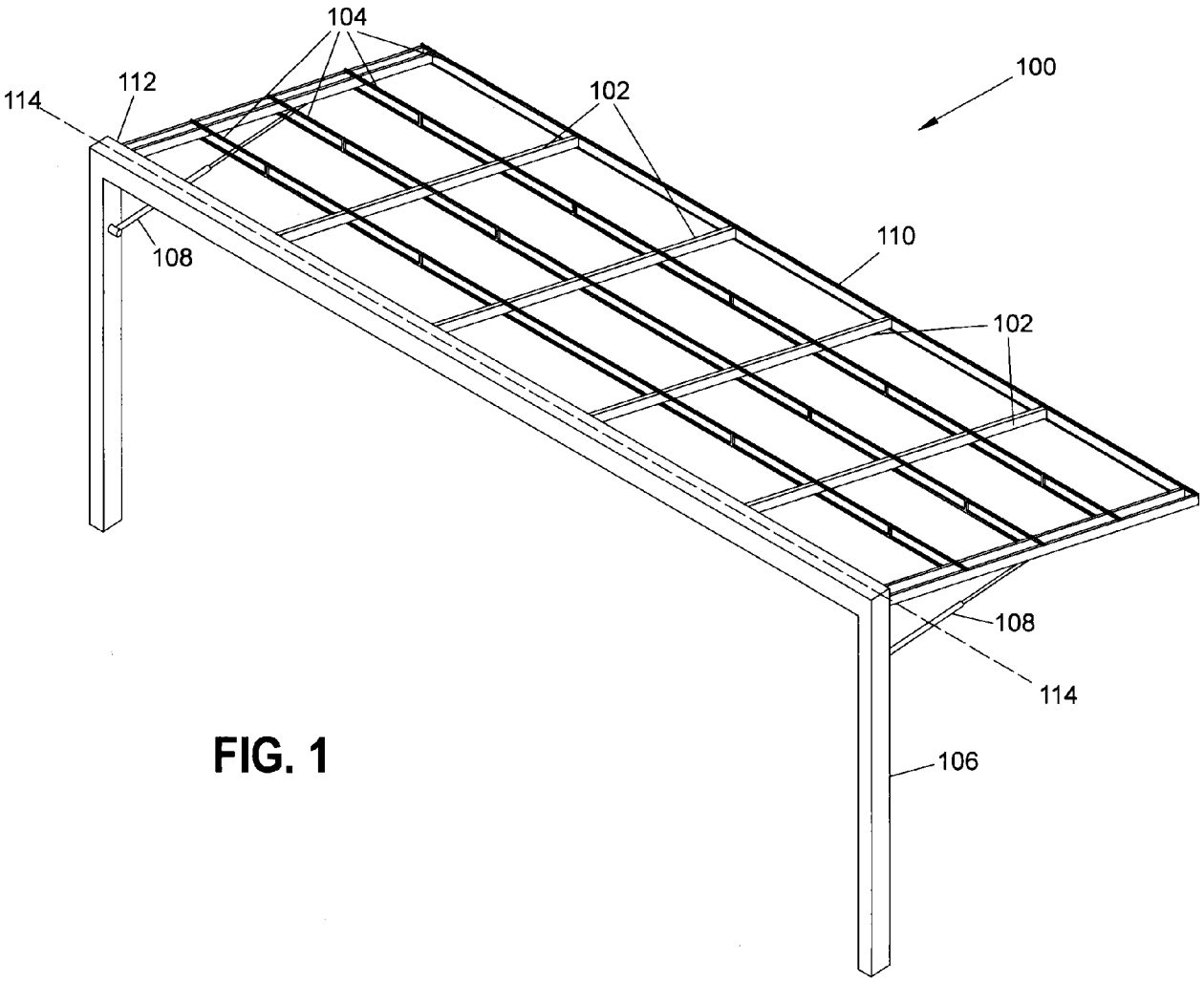
FIG. 1 is an isometric view of a garage door according to one embodiment of the present invention.

In the following detailed description of the embodiments, reference is made to the accompanying drawings that form a part hereof. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The following detailed description is, therefore, not to be taken in a limiting sense, and the scope of the present disclosure is defined only by the appended claims, along with the full scope of equivalents to which such claims are entitled.

Referring to FIG. 1, a one piece swing type garage door 100 has vertical 102 and horizontal 104 trussing that intersects in a number of locations over the span of the door 100. The vertical trussing pieces 102 and horizontal trussing pieces 104 serve to distribute a load on the door from the trussing to the external frame 106 of the door, which is typically stronger than the door itself Typical doors may have both horizontal and vertical trussing, or one or the other. However, for door 100, the horizontal and vertical trussing are interconnected to distribute load in both the horizontal and the vertical directions.

Figure 1A:
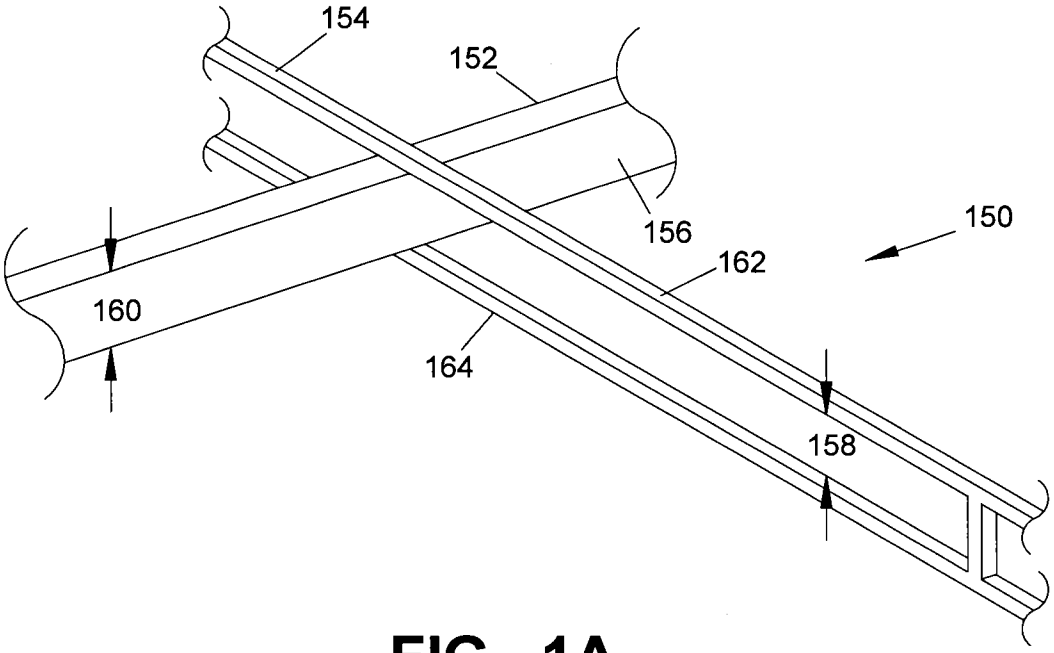
FIG. 1A is a more detailed view of a portion of the garage door of FIG. 1.

To accomplish this, the horizontal and vertical trussing is constructed as shown in greater detail in FIG. 1A. Individual vertical truss member 152 and individual horizontal truss member 154 are shown at an intersection 156 thereof. Horizontal truss member 154 has an opening 158 through which vertical truss member 152 extends. Horizontal truss member 154 has opening 158 configured in size in one embodiment to fit a width 160 of vertical truss member 152. Sides 162 and 164 of horizontal truss member 154 are on either side of the vertical truss member 152. Because of this, when assembled, the truss members 152 and 154 provide a distributed load from stress from either side of the door. In one embodiment, the vertical truss members 152 and vertical truss members 154 are joined at the intersection 1566, for example by bolting, welding, epoxying, or the like.

The interconnection of the vertical and horizontal truss members spreads a load on the door 100 over the entire frame. Loads, such as from lifting of the door 100 and wind loading, are dispersed both horizontally and vertically, as opposed to traditional loads being dispersed only vertically.

Door hydraulics 108 are connected between the frame 106 and the door body 110 so as to open the door 100 by moving the door body 110 in response to the door hydraulics 108. Hydraulics 108 are hinged so as to rotate about their mounting points at the door frame 106 and at the door body 110. When hydraulics 108 are actuated, using a hydraulic motor or hydraulic controller (not shown), a hydraulic cylinder of the hydraulics 108 extends and opens the door. The door body 110 is hingedly connected to door frame 106 along its top 112, and rotates on a rotational axis 114 between open and closed positions.

If there is an increased wind load or expected extra wind load on a door such as door 100, the depth of the horizontal trusses is increased in one embodiment. In contrast, typical doors would increase the number of vertical trusses or make them much larger in size and thickness, adding extra weight. The increase in the depth of the horizontal trusses, that is their depth in a direction substantially perpendicular to the face of the door 100, which adds some weight, but not much, for the resulting increase in handling a wind load.

Figure 2:
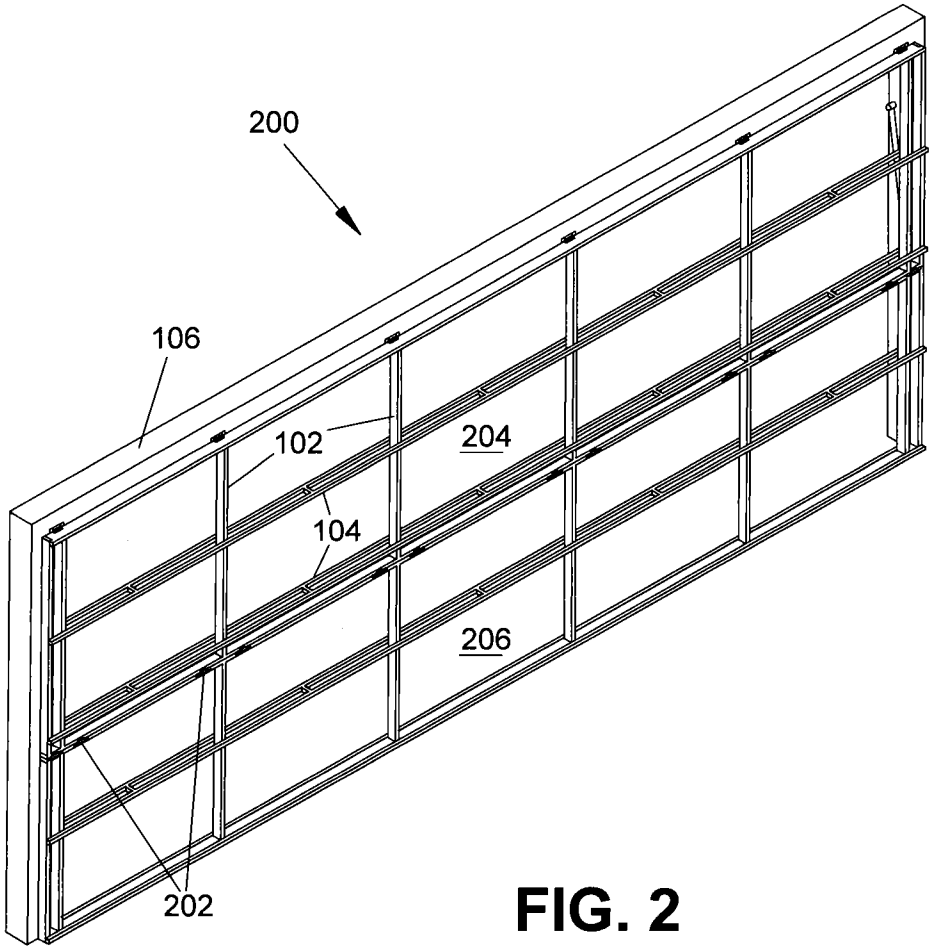
FIG. 2 is an isometric view of a garage door according to another embodiment of the present invention.

FIG. 2 shows a door 200 according to another embodiment of the present invention. Door 200 has a hinge 202 extending horizontally across the door, hingedly connecting top section 204 and bottom section 206 of the door 200. The hinge 202 allows the door 200 to be shipped in a folded orientation, while still having the sections 204 and 206 connected to each other. This makes the door 200 easier to ship, and also requires less installation time than a typical door, since a typical door is shipped in sections that must be assembled on site. The hinge 202 extends in this embodiment horizontally along the door 200. In shipping, the door 200 is folded along hinge 202. To prepare the door 200 for installation, the door is unfolded, and pins 208 are used to pin the top and bottom sections 204 and 206 together quickly and reliably.

Figure 3:
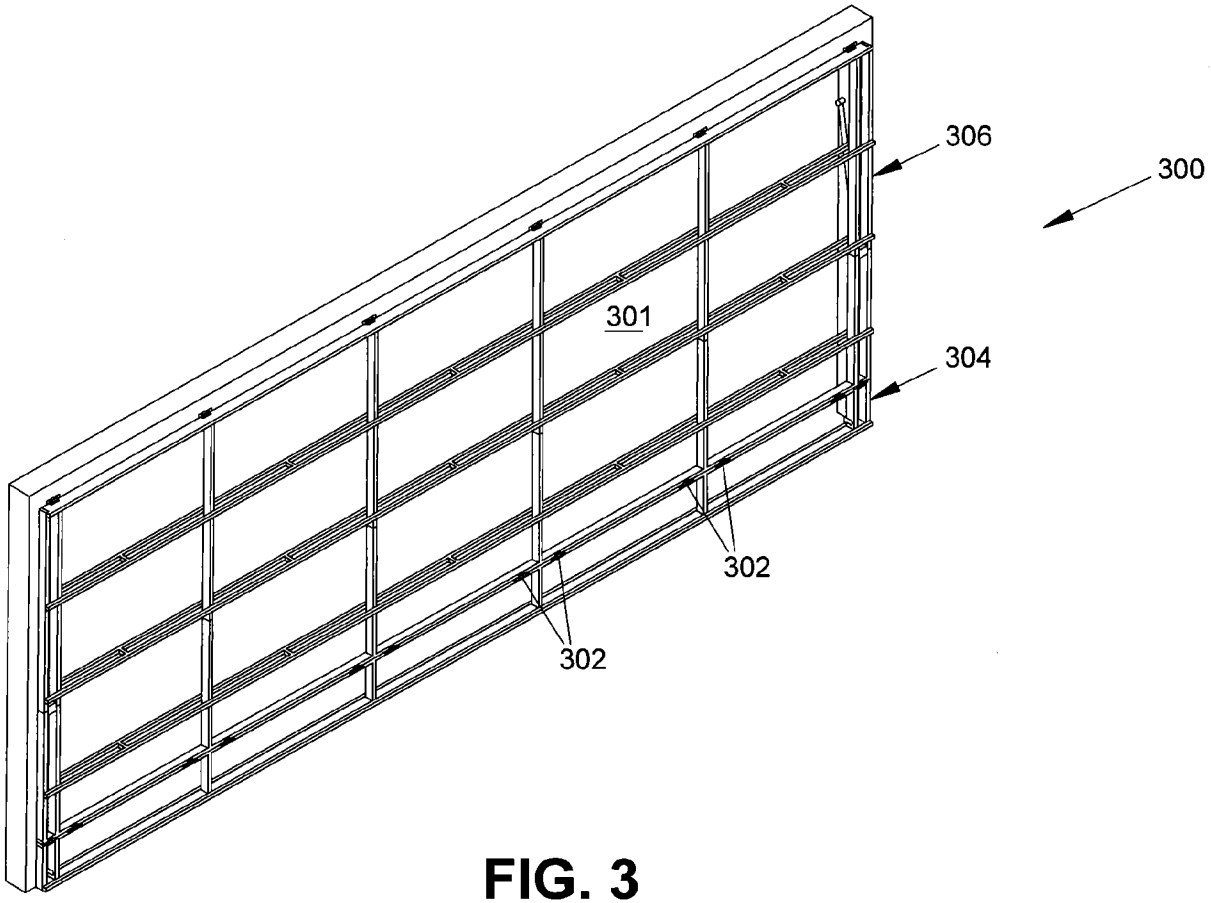
FIG. 3 is an isometric view of a garage door having a door load truss according to another embodiment of the present invention.
Figure 3A:
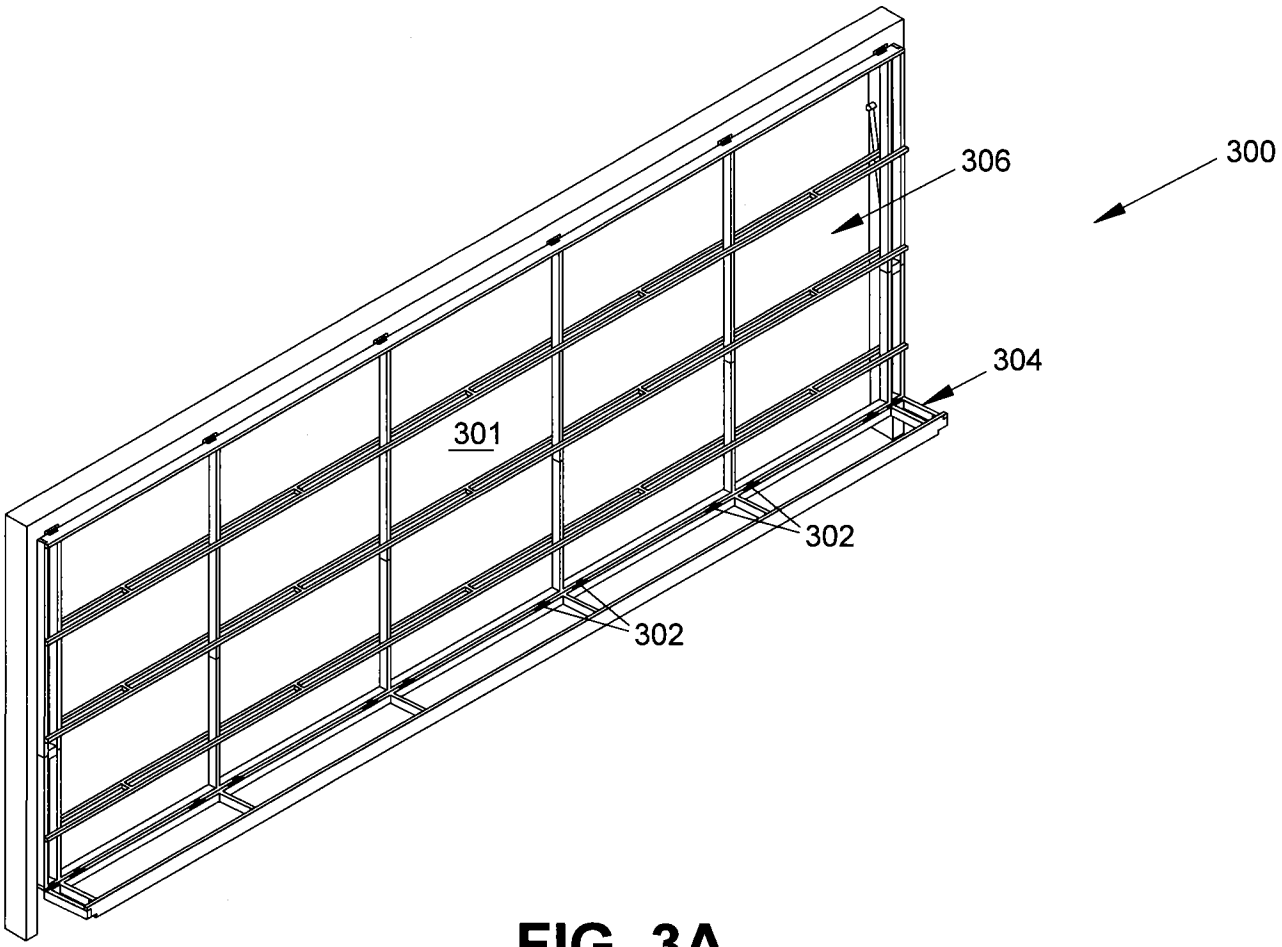
FIG. 3A is a view of the garage door of FIG. 3 with the door load truss in another position.
Figure 3B:
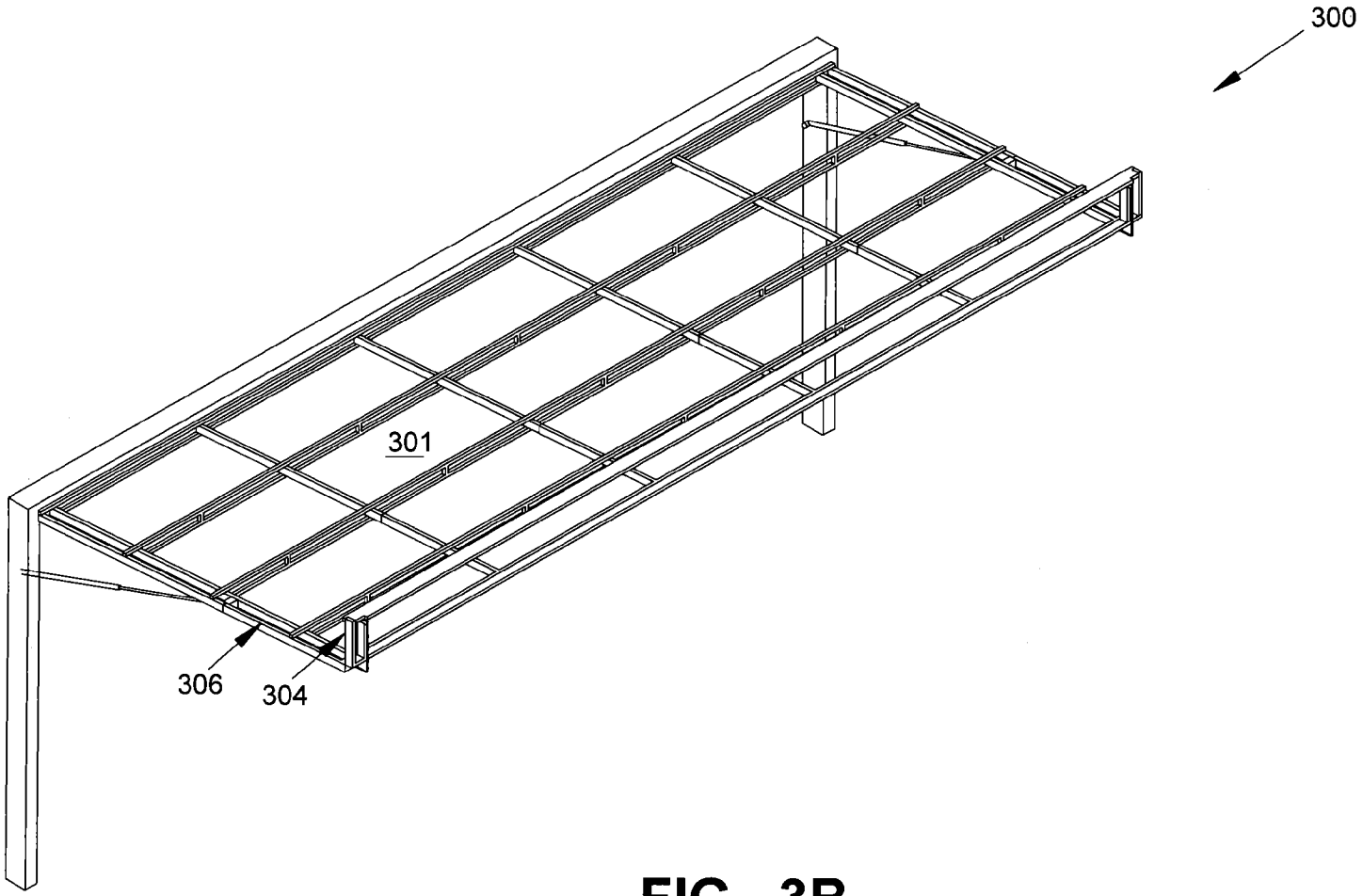
FIG. 3B is a view of the garage door of FIG. 3A with the door shown in an open position.

In yet another embodiment, a door 300 is shown in FIGS. 3, 3A, and 3B. Door 300 has a hinge 302 hingedly connecting a top section 306 and a door load truss section 304. In normal operation of the door 300 when it is closed (FIG. 3), the sections 304 and 306 are co-planar and locked in that position with pins 308, so that the door 300 functions as any other door. However, when the door 300 is opened (FIG. 3B), the door load truss section 304 is rotated about hinge 302 to a position in which it is substantially perpendicular to the section 306, forming a door load truss that assists in prevention of sagging of the door 300, due to its weight and/or size, during opening and while the door 300 is open. In this embodiment, then, the door load truss 304 is only used as a load truss when the door 300 is open. In contrast, normal door load trusses are permanently affixed in a position where they are substantially perpendicular to the face of the door. These normal door load trusses require additional materials, and present potential obstacles when working around the door. The folding truss allows a cleaner profile for the door when it is down, but still provides the horizontal stability of a permanent truss when the door is opened or is in the open position.

As shown in FIG. 3A, the hinged operation of the door load truss section 304 does not interfere with the closing of the door 300, and the door load truss section 304 can be maintained in its load bearing position in which it is substantially perpendicular to door face 301 of section 306. In this configuration, the door load truss section 304 also provides windage loading support for the door 300.

Figure 4:
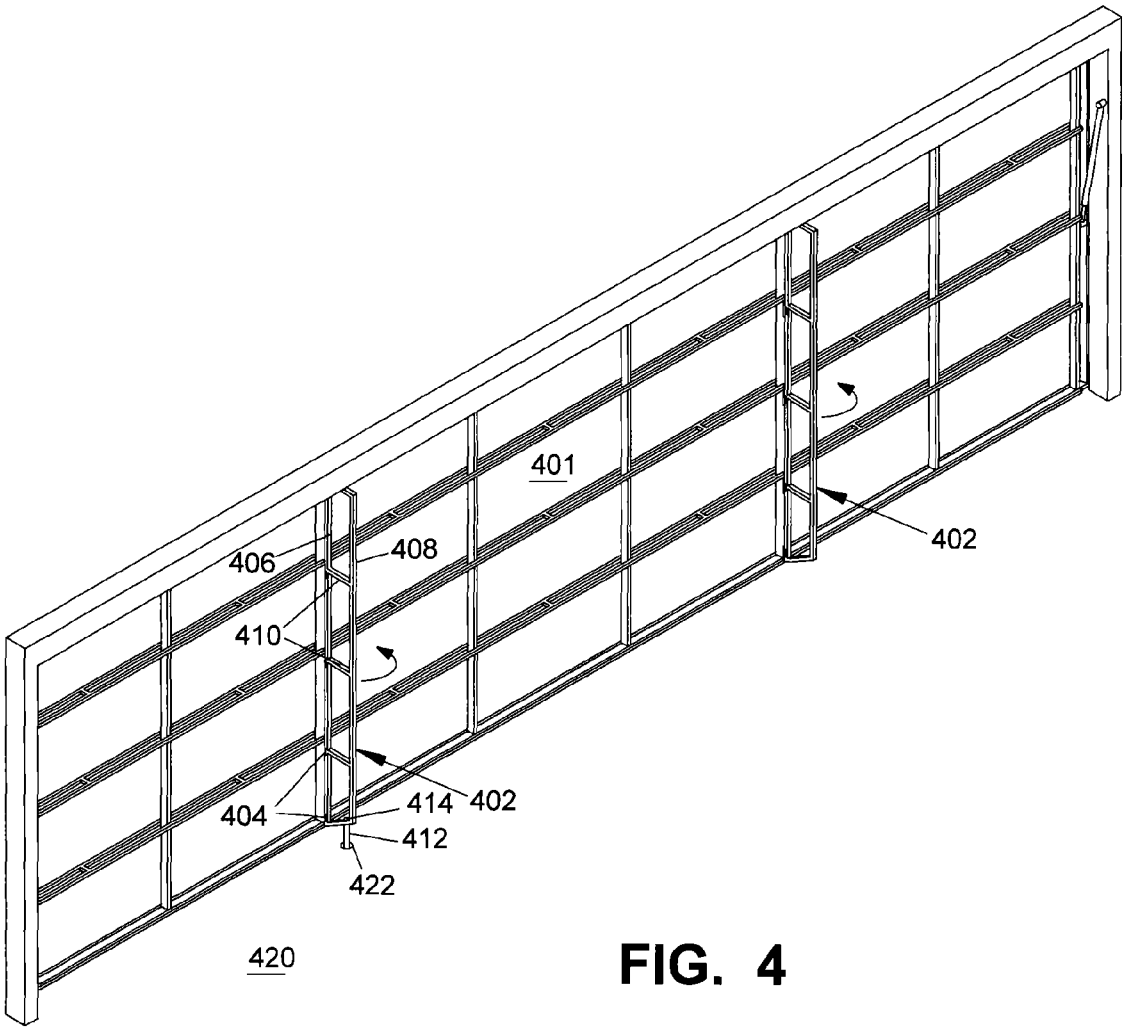
FIG. 4 is an isometric view of a garage door having door braces according to another embodiment of the present invention.
Figure 4A:
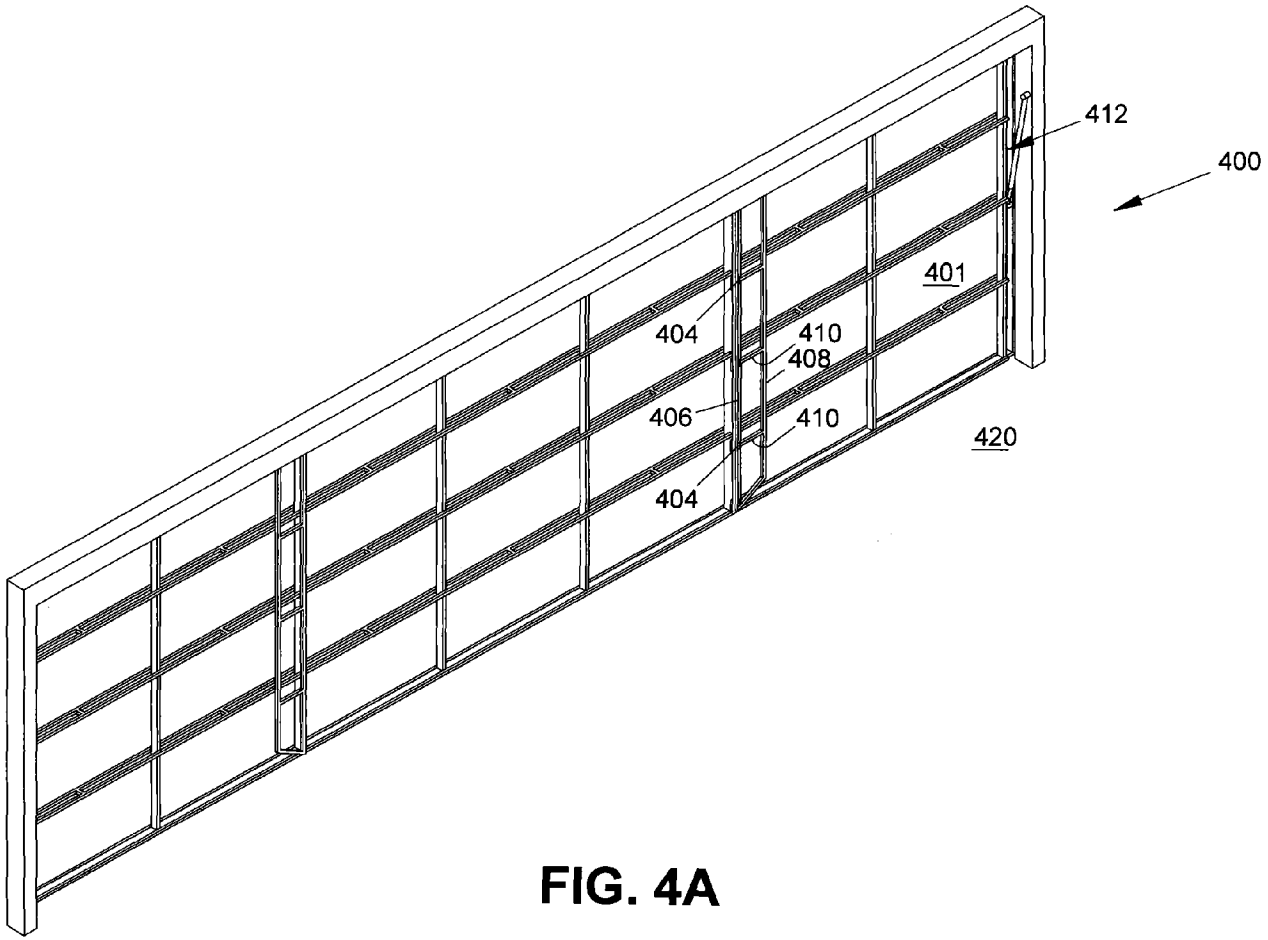
FIG. 4A is a view of the garage door of FIG. 4 with the door braces in a folded position.

In still another embodiment, shown in FIGS. 4 and 4A, door 400 has at least one (two are shown, although more or fewer are within the scope of the disclosure) added brace 402. Brace 402 is in one embodiment movable on hinges 404 between a first position in which brace 402 is substantially perpendicular to door face 401 and a second folded-in position in which brace 402 is substantially parallel and adjacent to door face 401 (see FIG. 4A). Brace 402 has a first vertical member 406 and a second vertical member 408 substantially parallel to first vertical member 406. Vertical members 406 and 408 are separated by horizontal members 410. When the brace 402 is in its first position, it can in one embodiment be pinned or otherwise secured to a floor 420 to provide additional wind loading for the door 400. If pinned, brace 402 has a pin 412 that may be placed through a hole or opening 414 in brace 402 and which extends into a hole 422 in the floor 420 or the like. In its first position, brace 402 provides additional structural support for the door 400, and the ability to secure the brace to floor 420 provides further structural stability especially in high wind situations. When two braces 402 are used and are in their first positions, the door frame is loaded in three sections.

Door braces are attached to the main door section 412 for added wind loading and stiffening when the door 400 is down. For high wind situations, such as for a hurricane or the like, the normally folded door braces 402 are extended to be substantially perpendicular to the door. When additional wind loading is required, the braces are unfolded to approximately a 90 degree angle to the door, adding additional stability and loading. The braces can then be pinned to the floor or the like. Also, the positioning of the braces breaks the loading down into approximately three equal pieces of the main door. Alternatively, the braces 402 can be permanently or semi-permanently pinned in their first open positions if desired.

One of more of the embodiments and variations described above can be integrated with a door of the type described. The hinged door load truss 304 of FIG. 3 can be used on other types of doors as well.

Combinations are within scope of the disclosure, for example a door can have the hinged sections of FIG. 2 combined with the horizontal and vertical integrated trussing of FIG. 1. Such combinations will be understood by those of skill in the art to be within the scope of the disclosure.

CONCLUSION

A swing-type garage door has been described that includes in various embodiments one or more of: hinged sections for ease of transfer and installation; integrated horizontal and vertical trussing to distribute wind loading; a door load truss that is integral with the door and only folds perpendicular for opening and open doors; and door braces pinnable to a floor for additional structural stability in storms and the like.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A swing type garage door, comprising:

a door body rotationally connected to a door frame, the door body rotatable between a first closed position and a second open position, the door body having a plane defined by a face of the door body;

wherein the door body has a main door body section and a door load truss section, the door load truss section hingedly connected at a bottom of the main door body section and at a top of the door load truss section and rotatable on a horizontal axis substantially coplanar and parallel with the plane of the door body between a first configuration in which the main door body section and the door load truss section are coplanar with the plane of the door body where the door load truss section extends downwardly from the bottom of the main door body section, and a second configuration in which the door load truss section is substantially perpendicular to the main door body section where the door load truss section assists in prevention of sagging of the door body during opening and when the door body is in the second open position.

2. The garage door of claim 1, wherein the door load truss section is approximately eight inches in height.

* * * * *